US005351417A

United States Patent [19]

Rubin

[11] Patent Number: 5,351,417

[45] Date of Patent: Oct. 4, 1994

[54] HAIR DRYER APPARATUS ADAPTED FOR MULTI-FUNCTIONAL USAGE

[75] Inventor: Richard Rubin, Melbourne, Australia

[73] Assignee: Secajo, Ltd., Raratowga, Cook Islands

[21] Appl. No.: 949,470

[22] Filed: Sep. 22, 1992

[51] Int. Cl.[5] ..... F26B 19/00

[52] U.S. Cl. ..... 34/90; 34/97; 34/572; 392/380

[58] Field of Search ..... 34/90, 91, 96, 97, 29, 34/54, 55; 392/379, 380, 382, 381

[56] References Cited

U.S. PATENT DOCUMENTS

| | | | |
|---|---|---|---|
| 3,289,313 | 12/1966 | Lechner, Jr. et al. | 34/91 |
| 3,578,000 | 5/1971 | Horecky | 34/90 |
| 4,195,416 | 4/1980 | Hall | 34/90 |
| 4,802,287 | 2/1989 | Chen | 34/91 |
| 4,868,998 | 9/1989 | Rubin | 34/91 |
| 5,107,603 | 4/1992 | Durazzani | 34/90 |
| 5,177,879 | 1/1993 | Muta | 34/90 |

*Primary Examiner*—Denise Gromada
*Attorney, Agent, or Firm*—Ladas & Parry

[57] ABSTRACT

A hair dryer adapted for multifunctional use includes a housing which is mounted on a wall and a hand-held dryer connected to a power supply in the housing through an electrical cable. The power supply to the dryer is controlled by the degree of extension of the cable from the housing. The housing is adapted to receive a number of different modules which can be installed with security in the housing. A tumble dryer can be incorporated into the housing. The apparatus can be provided with a switching device which controls the supply of heated air from the dryer to selected heated air utilization devices such as the tumble dryer, a hand and nail dryer, a room heater and a defogger outlet.

23 Claims, 12 Drawing Sheets

111
12 VDC OUT
121
118
GFCI AND TIMER CIRCUIT BOARD 110
119
117
120
115
116
21
NO
28
NO
20
TIMER SWITCH 122
113a
113
GFCI 114
112
220V

HAIR DRYER APPARATUS ADAPTED FOR MULTI-FUNCTIONAL USAGE

FIELD OF THE INVENTION

The invention relates to hair dryer apparatus adapted for multifunctional usage in which a plurality of accessory units can be selectively utilized in the apparatus. Such accessory units may include such electrical utilization means as electric shaver sockets, an air freshener, an illuminated mirror, a radio, a television set and the like.

The multi-functional usage of the hair dryer apparatus also includes using the heated air from a hand-held hair dryer of the apparatus for a tumble dryer, hand and nail drying, room heating, defogging purposes and the like.

In my earlier U.S. Pat. No. 4,868,998, there is disclosed the use of a tumble dryer in a hair dryer apparatus in which the rotation of a drum of the tumble dryer and the source of drying heat is obtained from the heated air produced by the hand-held hair dryer of the apparatus. The constructing of the hair dryer itself is disclosed in my U.S. Pat. No. 4,700,049.

The hair dryer apparatus is intended for use in a bathroom. There are two major safety requirements for the usage of such apparatus in a bathroom:

i) Any electrical appliance used in a bathroom must not be allowed to come into contact with water, especially when switched on, as the electrical current always remains in the product. The reason is that the contact of water and electricity can cause death by electrocution.

ii) More than one appliance cannot be operated off one power point. Therefore, technically speaking each product, for example, a hairdryer garment dryer, air freshener, illuminated vanity mirror, and the like, must have its own power supply and Ground Fault Circuit Interruptor (GFCI), which will trip the electrical supply to the product as soon as contact with water is made. This involves a substantial cost to the user, whether a private homeowner or a hotel for a separate power supply, inclusive of a GFCI for each product.

I have provided a wall mounted hairdryer apparatus combining the hand-held hairdryer and electrical outlets for an electrical shaver into one unit. By utilizing an electronic control board, which distributes electrical power to both constituents in the unit, a multi-functional product is obtained which only requires one electrical power source.

An important fact of this apparatus is that all the electrical power supply is contained in a housing mounted on the wall. To operate the hairdryer, the user simply removes the handle of the hairdryer from its temporary support in the housing, whereupon the hairdryer is automatically activated. Therefore, there is no need for human contact with the electricity near water. Because the housing is fixed to the wall and therefore cannot be dropped into water, the product is safe for use in the bathroom.

A disadvantage of the combined unit is that not all users want the shaver outlets and it becomes necessary to manufacture and store both the combined units and those with the dryer alone.

SUMMARY OF THE INVENTION

An object of the invention is to provide hair dryer apparatus having a multi-functional usage which avoids the deficiencies of heretofore known combined units while meeting all safely requirements.

A further object of the invention is to provide such apparatus which gives a multi-functional usage in which the configuration of the apparatus for the different usages is quickly and securely effected by selective use of one or more of a plurality of interchangeable modules. This object is satisfied by hair dryer apparatus adapted for multi-functional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held dryer with an opening at said receptacle through which heated air produced by said dryer is introduced into said housing, at least one air outlet in said housing, and control means accessible from outside said housing for selectively directing the heated air from said dryer to said air outlet.

Another object of the invention is to provide heated air flow and electrical power to said interchangeable modules from a common source of heated air and a common electrical power supply.

Another object of the invention is to provide such apparatus which has exceptional electrical safety requirements. This object is satisfied by utilizing the electrical power cord of the hand-held dryer to electrically connect the dryer to the power source only after the power cord is extended from the housing by a pre-set amount and by providing a GFCI in the electrical power supply.

A further object or the invention is to provide multifunctional usage of the heated air from the hand-held dryer for hand and nail drying, room heating, mirror defogging, and as a heating source for a tumble dryer or the like. This object is satisfied by hair dryer apparatus adapted for multifunctional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held dryer with an opening at said receptacle through which heated air produced by said dryer is introduced into said housing, at least one air outlet in said housing, and control means accessible from outside said housing for selectively directing the heated air from said dryer to said air outlet.

Another object of the invention is to utilize a common electrical input as an electrical power supply for interchangeable modules which can be of wide-ranging type including units with shaver plugs, air fresheners, illuminated mirrors, and the like. This object is satisfied by hair dryer apparatus adapted for multi-functional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held dryer with an opening at said receptacle through which heated air produced by said dryer is introduced into said housing, a plurality of modular accessory units, means in said housing for detachable connection of a selected modular accessory unit to said housing, circuit means connected to said electrical supply means for providing an electrical outlet connection in said housing, each said modular accessory unit including electrical utilization means with inputs which are electrically connected to said electrical outlet connection when the accessory unit is connected to said housing.

DETAILED DESCRIPTION

Figure 1:
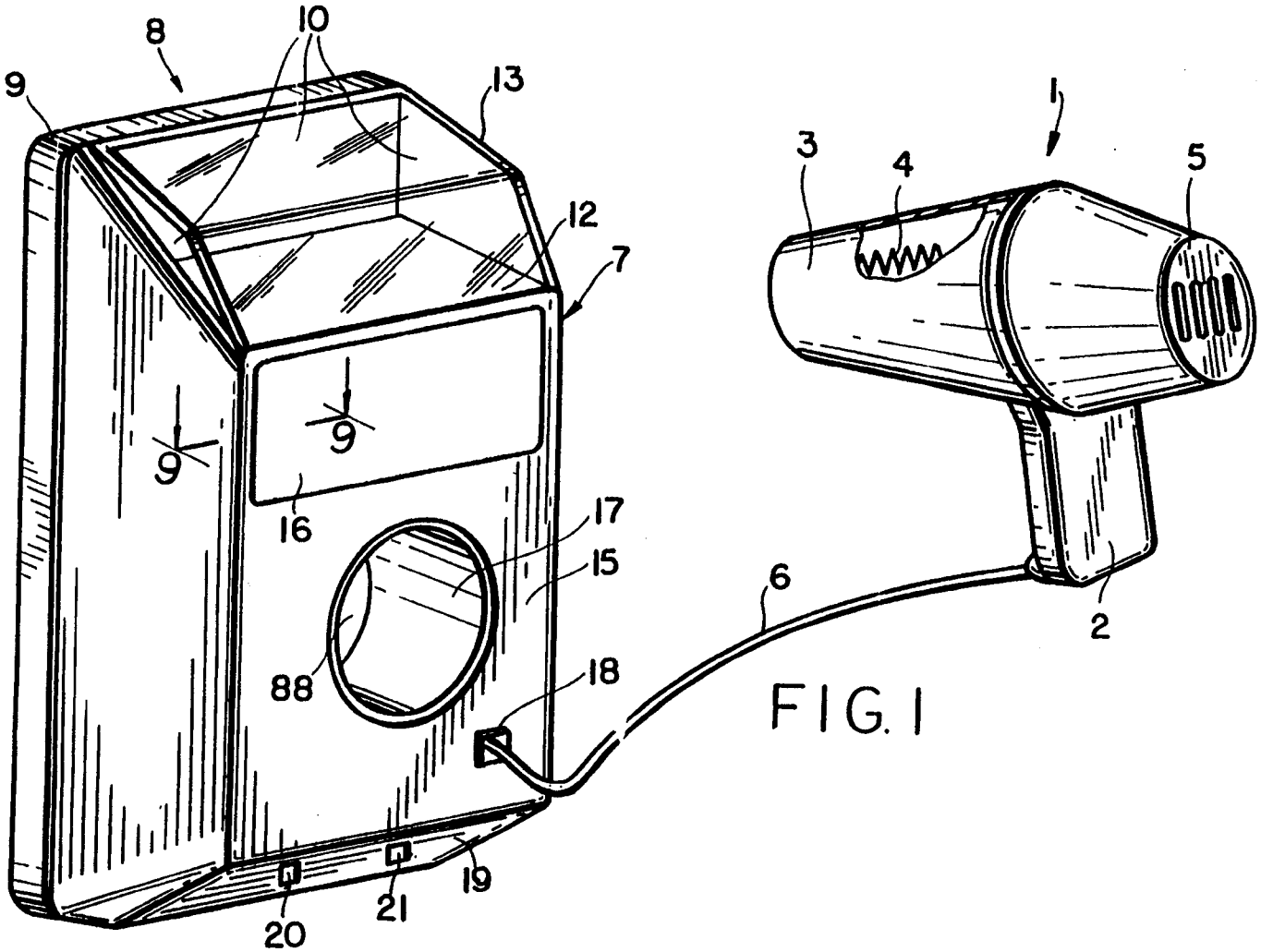
FIG. 1 is a perspective view of a first embodiment of hair dryer apparatus according to the invention.

FIG. 1 shows a first embodiment of hair drying apparatus according to the invention comprising a hand-held hand dryer 1 having a gripping handle 2 and a nozzle 3 for discharging heated air from the dryer 1. A heating element 4 is contained within the dryer 1 for heating the air. As is conventional a motor (not shown) is contained within the dryer 1 for driving a fan in rotation to produce a flow of air from inlet slots 5 to and through the nozzle 3. An electrical cable 6 connects the dryer motor and heater 4 to an electrical supply means within a housing 7. The housing 7 is secured to a wall 8 or other rigid and secure support surface by detachably connecting the housing 7 to a base 9 fixed to the wall. The housing 7 is made of a plastic material. The top or housing 7 is formed with upstanding walls 10 partially enclosing a space 11 with a fiat bottom or shelf 12. Various articles which are normally found in the bathroom, such as razors, toothbrushes, or the like can be placed on shelf 12 within space 11. A cover 13 is hinged at the back wall of the housing 7 for closing the space 11. The cover 13 can be made of transparent material. At the left, front, portion of the shelf 12 is a hole 14 in which a special tool can be inserted to lock and unlock selected modules in the housing in a manner to be explained more fully later. At the top of a front wall 15 of housing 7 there is a cut-out 16 for insertion of a module, such as one of those shown in FIGS. 8A–8G and to be described more fully later. The cut-out 16 extends across substantially the entire width of wall 15 and normally is covered by the face plate of the module or by a detachably blank closure plate if no module is present in the cut-out.

Below the cut-out 16 is a recess or receptacle 17 for the insertion and support of the nozzle 3 of the dryer 1. The receptacle 17 is inclined downwardly within the housing to support the dryer with stability. The electrical cable 6 is retractable into the housing 7 through an opening 18. The bottom wall 19 of the housing 7 slopes downwardly towards the back and test and reset switches 20 and 21 respectively of a ground fault circuit interrupter (GFCI) project at the face of wall 19.

Figure 2:
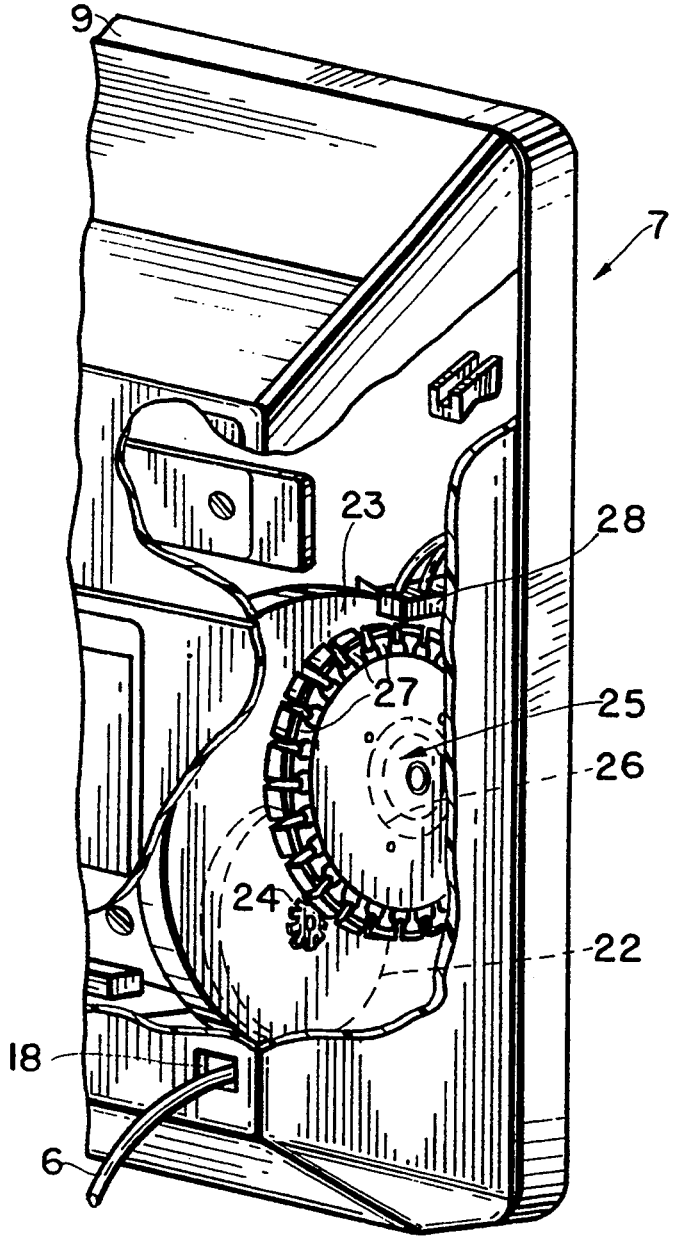
FIG. 2 illustrates a portion of the embodiment in FIG. 1 partly broken away to show internal details.

FIG. 2 shows the housing 7 with a portion of the front wall 15 broken away to reveal within the housing 7 a rotatable reel 22 within a casing 23. The cable 6 is wound on reel 22 and is connected to a power supply. A reduction gear 24 is secured to reel 22 to rotate therewith. The reduction gear 24 rotatably drives a daisy wheel 25 supported by the casing 23. The gear arrangement is such that when the cable 6 is fully extended from the housing 7 and the hair dryer I is at its maximum reach from the housing, the daisy wheel will have undergone one rotation (360°) from the fully retracted position of the cable. A torsion spring 26 between the daisy wheel 25, and the casing 23 applies torsional moment to urge the daisy wheel to retract the cable 6. The daisy wheel 25 has a plurality of spokes with bendable nodules 27 at their ends spaced circumferentially around the daisy wheel. A microswitch 28 is mounted in the housing 7 proximate the path of travel of the nodules when the daisy wheel undergoes rotation. By manually bending the nodules upwardly (radially outwards), actuation of the microswitch 28 can be controlled as a function of the length of the cable 6 extended from the housing 7. In this way the microswitch 28 can be operated to control connection of the power supply to the dryer 1 only when the dryer has been extended in a pre-set range. Namely, depending on the particular nodules which are bent upwards, the power supply to the dryer can be activated beginning when the dryer 1 is extended the pre-set distance from the receptacle 17 and the power supply will be continued until it is disconnected when the dryer has been extended a distance beyond which the last upwardly bent nodule has passed the microswitch 28. Hence, the dryer 1 can be energized only when the dryer 1 is displaced, for example, a distance away from a sink up to a maximum limit of extension of the cable 6 from the dryer 1.

Figure 8A:
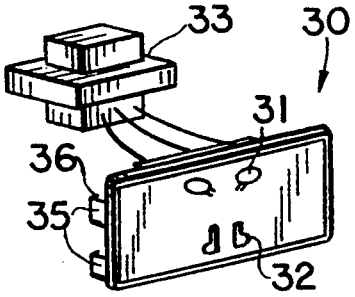
FIGS. 8A–8H illustrate various modules usable in the first and second embodiments of the invention.
Figure 9:
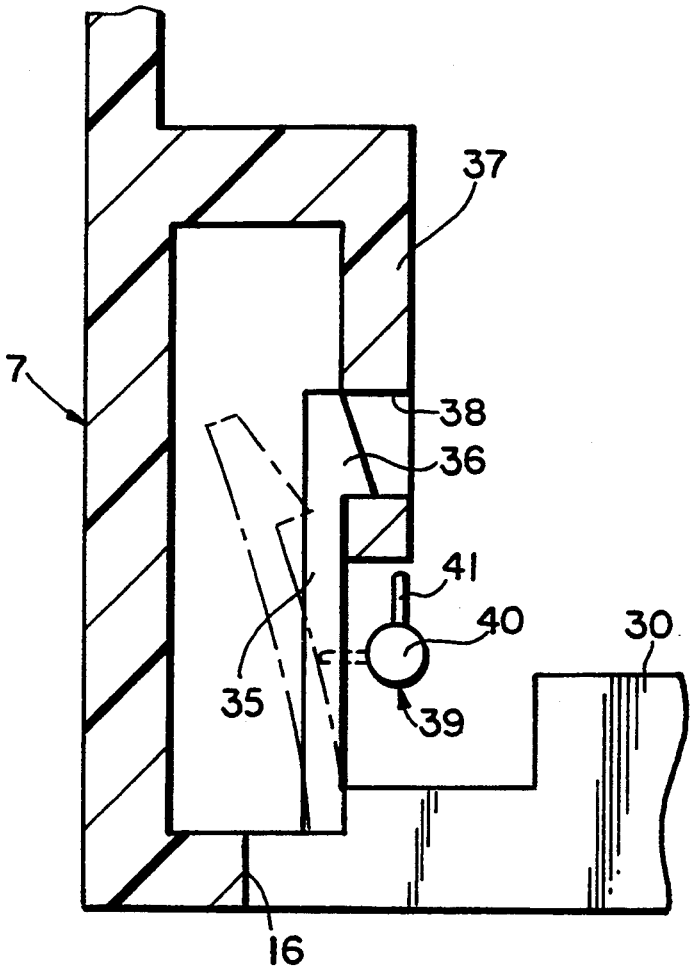
FIG. 9 is a sectional view taken on line 9—9 in FIG. 1.

FIG. 8A shows an embodiment of a shaver module 30 having shaver outlets 31 and 32 for supply of different voltages, e.g., 110 and 220 volts respectively. The shaver module 30 includes an isolation transformer 33 the function of which will be described later. In order to install the shaver module 30 in the housing 7 of the embodiment in FIG. 1, a closure plate for cut-out 6 is removed by unlatching the plate using a special tool inserted into the hole 14 and the module 30 is snap-fit in the cut-out 16 to securely hold the module in place in the housing 7. For this purpose, the module 30 includes flexible side tabs 35 with retaining lips 36 at their ends. The housing 7 is provided with rigid plugs 37 (FIG. 9) extending in a position adjacent to the position of the tabs 35 on each of the modules. The plugs 37 are provided with slots 38 into which the lips 36 snap when the module is inserted into the cut out 16. The engagement of the lips 36 in the slots 38 is generally sufficient to support the weight of the module but if supplemental support is required a shelf (not shown) can be molded in the housing. When the module 30 is installed in the housing it is not removable except by operating a release mechanism 39 controlled by the tool inserted into the hole 14. The release mechanism 39 comprises a turnable shaft 40 supported in the housing 7 and rotated by turning the tool in the hole 14. Fixedly mounted on the shaft 40 are fingers 41 which act on the tabs 35 when the shaft 40 is turned to deflect the tabs 35 and release the lips 36 from the slots 38, as shown in dotted outline in FIG. 9, thereby allowing removal of the module from the cut-out. All of the modules are constructed in the same way so that the modules are interchangeable in the cut-out. The modules all have electrical contacts (not shown) which connect the module in an electric circuit when the module is snap-fit in the cut-out. For this purpose conventional slide contacts can be used.

Figure 8C:
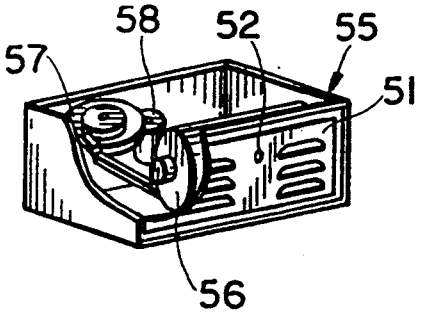
Figure 8B:
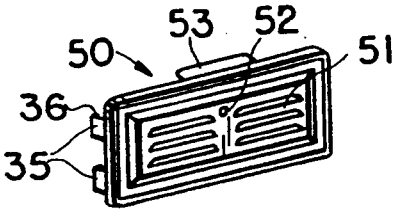

FIG. 8B shows a module 50 which functions as an air freshener. The module 50 has a grill 51 with louvre slots in its front face through which scented air can be discharged. The module 50 incorporates an infra red detector 52 capable of detecting human presence by virtue of heat and motion. The infrared detector 52 is connected to a 12 volt dc motor 53 which drives a fan (not shown) which forces air over a scented pad (not shown) which is located in proximity to the grill 51. When activated, the fan forces air over the scented pad to discharge the scented air through the grill 51. A timer is contained in the motor circuit to prolong the operation of the motor and fan for a preset time after the human presence is no longer detected.

FIG. 8C shows another embodiment 55 of an air freshener which incorporates an aerosol canister 56 which is activated by the rotation of a geared cam 57 driven by an electric motor 58. When the canister is activated, the nozzle thereof is forced inwards to expel a short burst of scented fluid at suitable intervals. When the detector 52 no longer senses the presence of a human, a further burst of scented fluid is released by a timed continued operation of the motor.

Figure 8D:
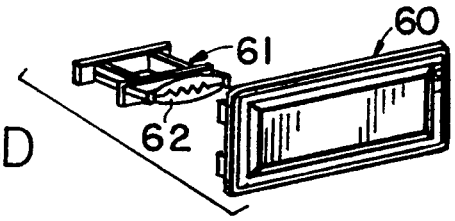

FIG. 8D shows a further embodiment of a module in the form of an illuminated panel 60. The panel 60 may contain advertising material or it can be blank. Additionally, the panel may be an illuminated mirror. The panel 60 is illuminated by a light illumination means 61 attached to the back of panel 60 so that a light emitting diode 62 of the light means 61 can illuminate the panel 60. The light means 61 is powered from the 12 volt dc supply of the electrical circuit when the module 60 is inserted into the cut out 16 of the hair dryer apparatus. The illumination of the panel 60 is continuous and thereby also can serve as a night light.

Figure 8E:
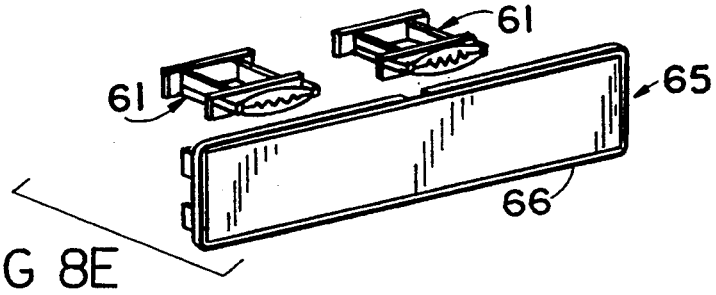

FIG. 8E is similar to FIG. 8D except that the module 65 illustrated therein is intended to be used in the embodiment of FIG. 3 (to be described later) and to extend over two cut outs to enlarge the size of the illuminated panel 66 of module 65. In this embodiment two light sources 61 are provided to illuminate the enlarged panel 66.

Figure 3:
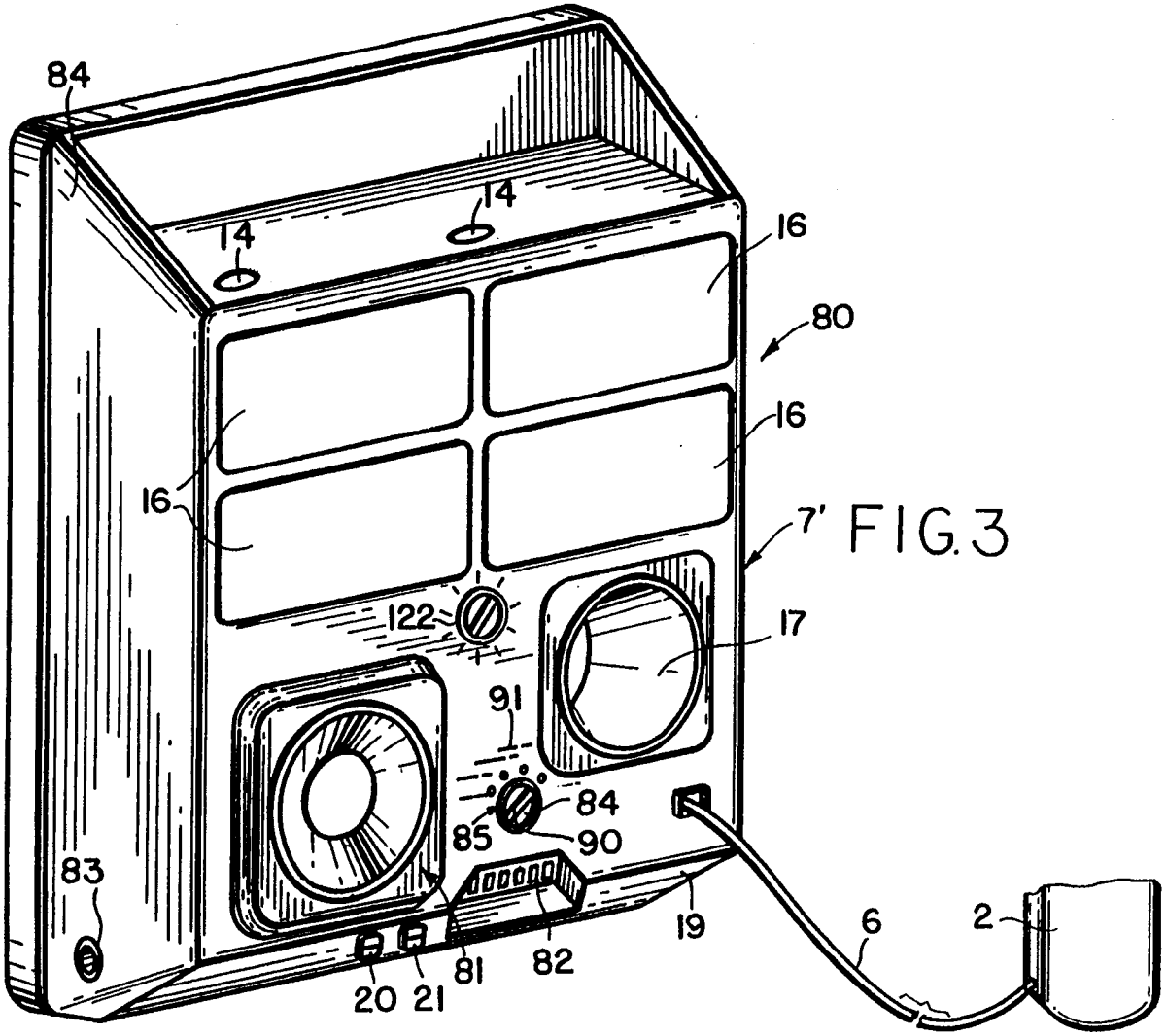
FIG. 3 is a perspective view of a second embodiment of hair dryer apparatus according to the invention.
Figure 4:
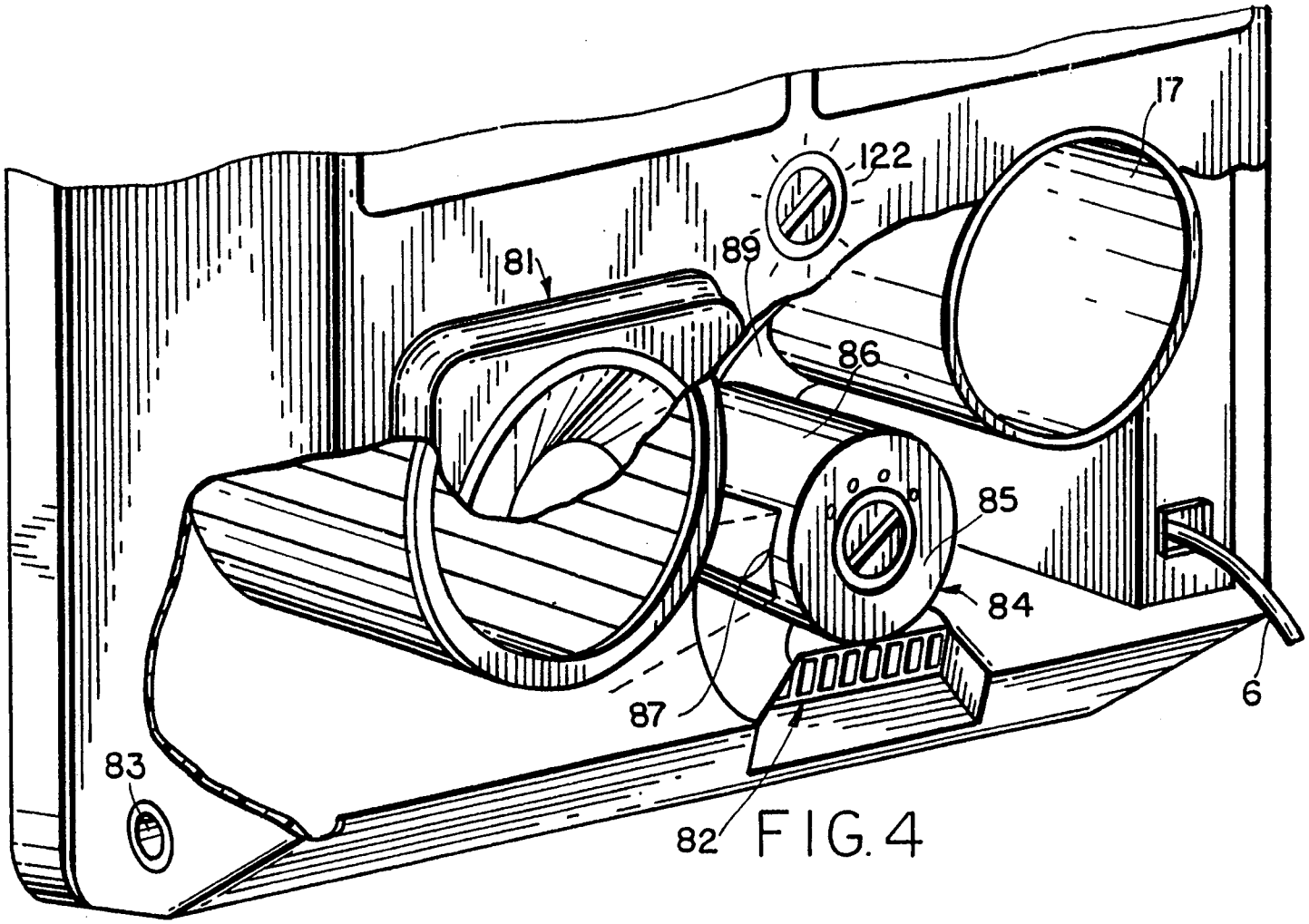
FIG. 4 illustrates, on enlarged scale, a portion of the embodiment in FIG. 3 partly broken away to show internal details.
Figure 8F:
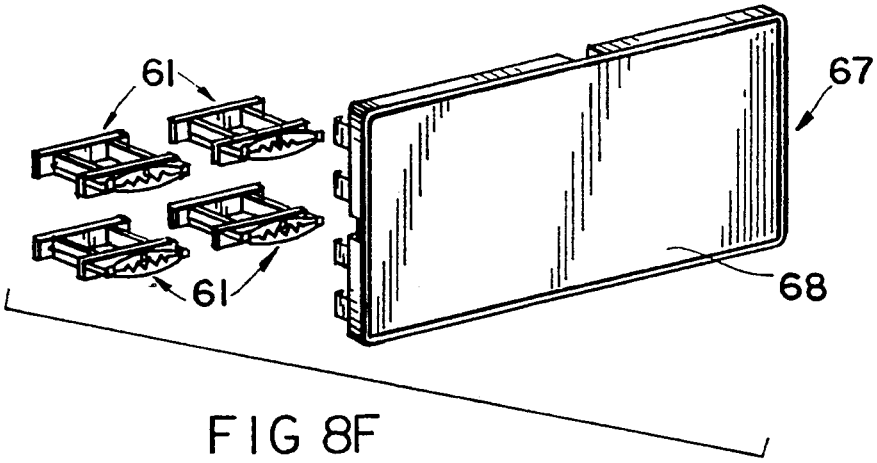

FIG. 8F shows another embodiment of a lighting panel 67 intended to cover four cut outs in the embodiment of FIG. 3. The illuminated panel 68 therefore is four times the size of that in FIG. 8B and four lighting means 61 are employed, one for each cut out.

Figure 8G:
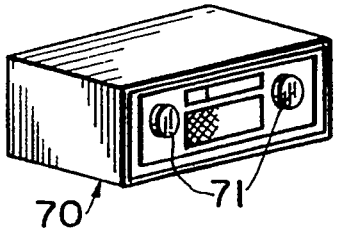

FIG. 8G illustrates a module 70 in the form of a radio having appropriate control dials 71 to select station and volume. In lieu of a radio, module 70 can be constructed as a television set.

Figure 8H:
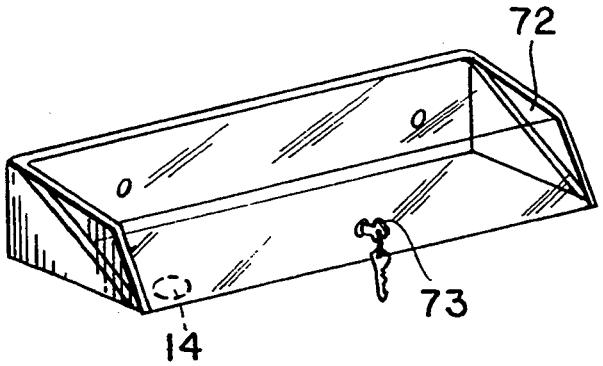

FIG. 8H shows a modification in which the lid 12 in FIG. 1 is replaced by a lockable lid 72 which is opened and closed by means of a key 73. In this way various amenities can be provided on shelf 12 within the space 11 at the top of the housing 7 and offered for sale in much the same manner as in mini-bars in hotels. This embodiment also has the advantage of keeping the hole 14 within the locked space. The lid 72 is made transparent in order o to display the amenities which are offered for sale.

The embodiment 80 of FIG. 3 is similar to that of FIG. 1 with the exception that it has four cut outs 16 for selectively receiving a multiple number of modules and additionally, it also includes a number of heated-air utilization means including a tumble dryer 81 whose construction and arrangement corresponds substantially to that in my earlier U.S. Pat. No. 4,868,998, the details of which are incorporated by reference herein. Briefly, the tumble dryer 81 is rotatably supported within the housing 7' for being rotated by the heated air from the dryer 1 when the nozzle 3 of the hair dryer is placed within the receptacle 17. The heated air passes through the dryer 81 to heat articles placed therein whereby the articles are subjected to tumbling and heating concurrently. In effect the embodiment of FIG. 1 is combined with the tumble dryer in the embodiment of FIG. 3.

The housing 7' of the embodiment 80 has outlet openings 82 in the bottom wall 19 from which heated air can be discharged to dry nail polish and/or the hands of a user. The openings 82 can also be used to supply heat to the bathroom. An aperture 83 is provided in the side wall 84 of the housing 7' for supplying heated air to defog a mirror or the like.

In order to control the flow of the heated-air to the selected heated-air utilization means a control means 84 having an external control switch 85 is provided. The control means 84 includes a rotatable drum 86 having an outlet slot 87 for discharge of heated air. The heated air from the dryer 1 flows through an opening 88 (FIG. 1) at the rear of the receptacle 17. The heated air flows into a manifold or channel 89 and then into the interior of the drum 86. The position of the drum determines which of the heated-air utilization means will receive the flow of heated air. The control switch 85 has a finger grip 90 for turning the drum 86 and the position of the finger grip 90 indicates the heated- air utilization means which is being supplied with heated air. Indicia 91 on the housing 7' indicate to the user the particular selected heated-air utilization means which receives the heatedair.

FIGS. 5 and 6A–6D show the positions of the control drum 86 and the different patterns of flow of the heated air produced thereby. The drum 86 is rotatably supported in a housing 92 having outlets 93, 94 and 95 respectively for conveying heated air to tumble dryer 81, nail and/or hand dryer outlets 82 and defogger outlet 83. Depending upon the position of the drum 86 the heated air will be selectively diverted to the various heated-air utilization means. In the position shown in FIG. 6A the drum 86 is oriented so that the slot 87 coincides with the outlet 94 so that all of the heated air is supplied to outlets 82 which provide for drying the hands of a user with maximum air flow. The air flow from outlets 82 can also be used to heat the bathroom.

Figure 6B:
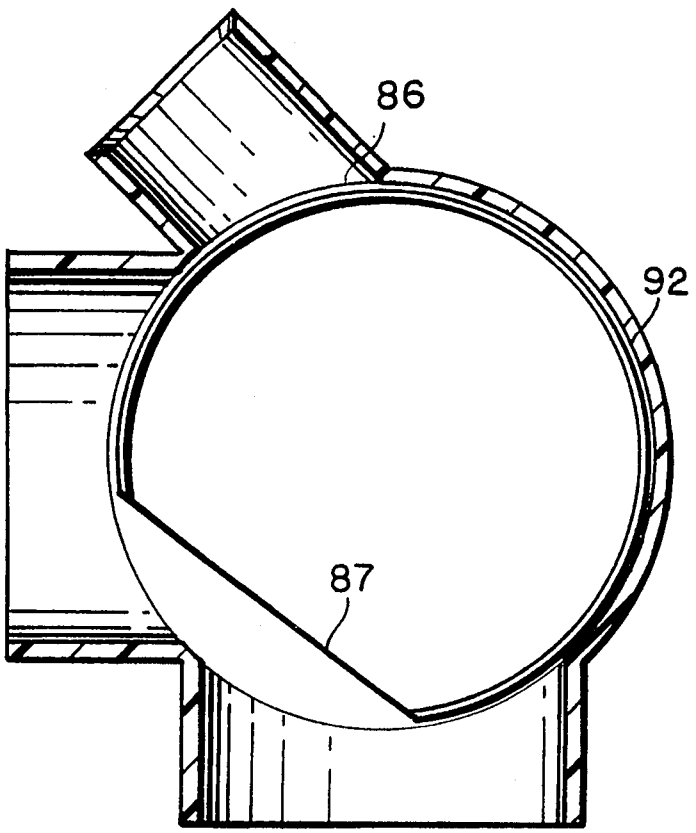
FIGS. 6A–6D illustrate different positions of a control means in the embodiment of FIG. 3 for air flow control.
Figure 6A:
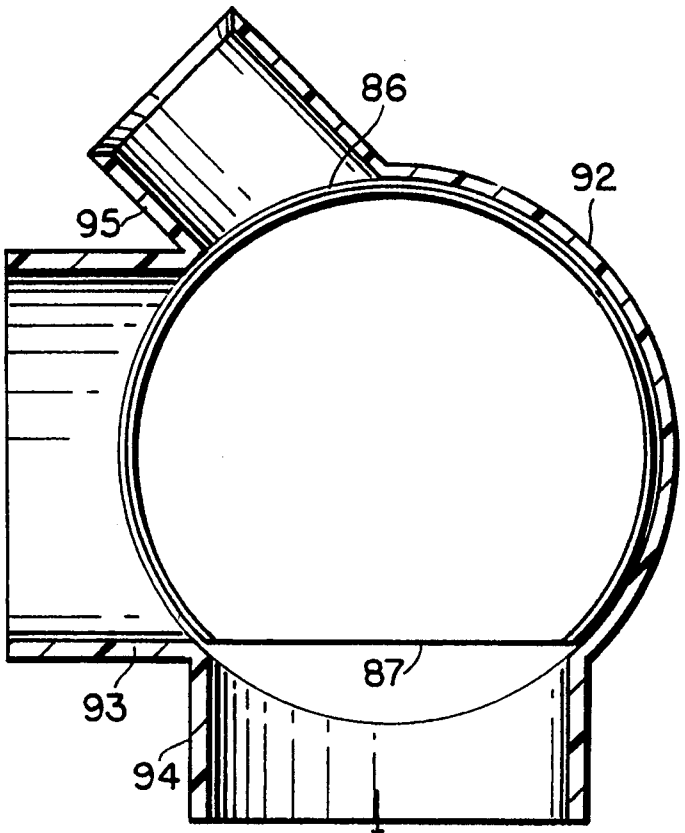

In FIG. 6B the drum 86 is oriented so that the slot 87 supplies less heated air to the outlets 82. In this position the reduced flow of heated air to the outlets 82 is suitable for a nail drying function.

Figure 6D:
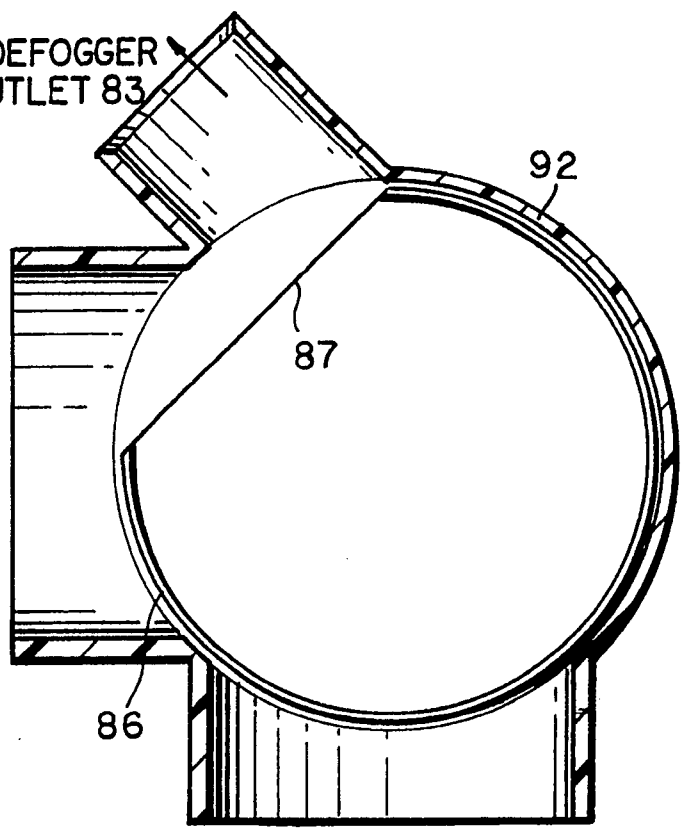
Figure 6C:
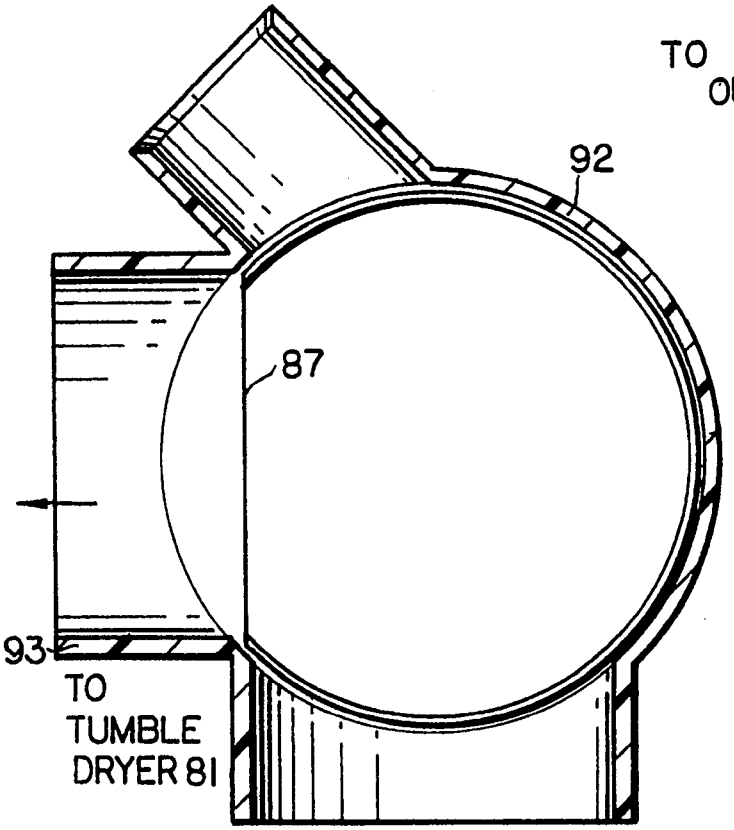

FIG. 6C shows the drum 86 in a position in which the outlet 87 coincides with the outlet 93 so that the entire amount of heated air flows to the tumble dryer 81.

In FIG. 6D the position of the drum 86 is such that the outlet 87 supplies heated air to the defogger outlet 83.

Figure 5:
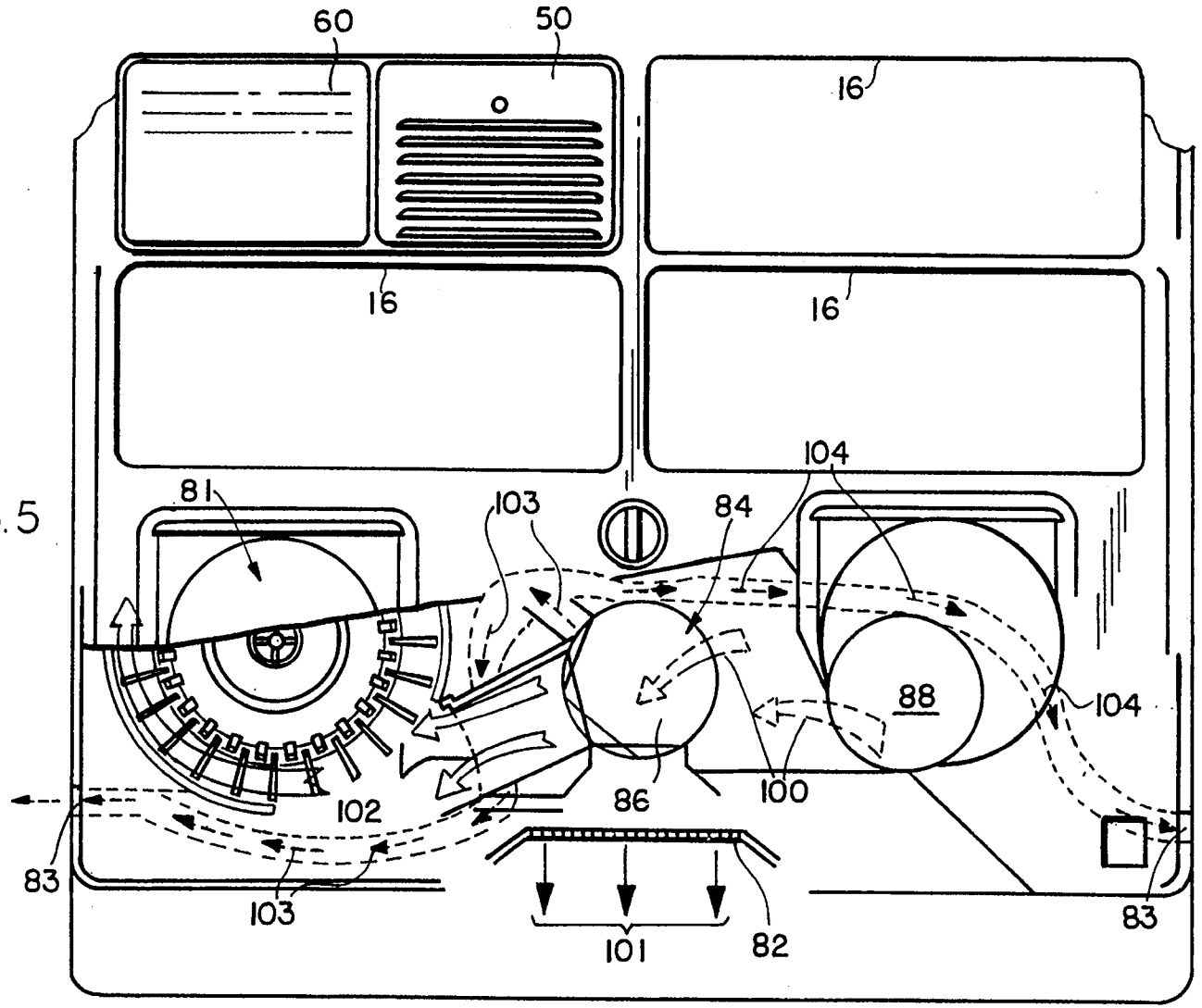
FIG. 5 is a diagrammatic illustration of heated air flow paths in the embodiment of FIG. 3.

The various patterns of flow of heated air are illustrated in FIG. 5. Therein the incoming heated air from the dryer 1 is shown at 100 and the heated air flows into the drum 86 through the channel 89. Depending on the position of the drum 86 the heated air can be supplied to outlets 82 along flow path 101, to the tumble dryer 81 along flow path 102 or to the defogger outlet along path 103. In the embodiment illustrated in FIG. 5 there is a second defogger outlet 83 provided at the right side of the housing 7' for outflow of a second part 104 of the defogger outlet air. In order to utilize the defogger air, a tube (not shown) is connected to the outlet 83 and affixed onto or adjacent to a mirror to be defogged. The tube contains a slit therein extending substantially the entire width of the mirror and the tube is sealed at its remote end so that when defogger air is supplied to the tube the defogger air will "wash" the mirror to prevent fogging thereof.

Figure 7A:
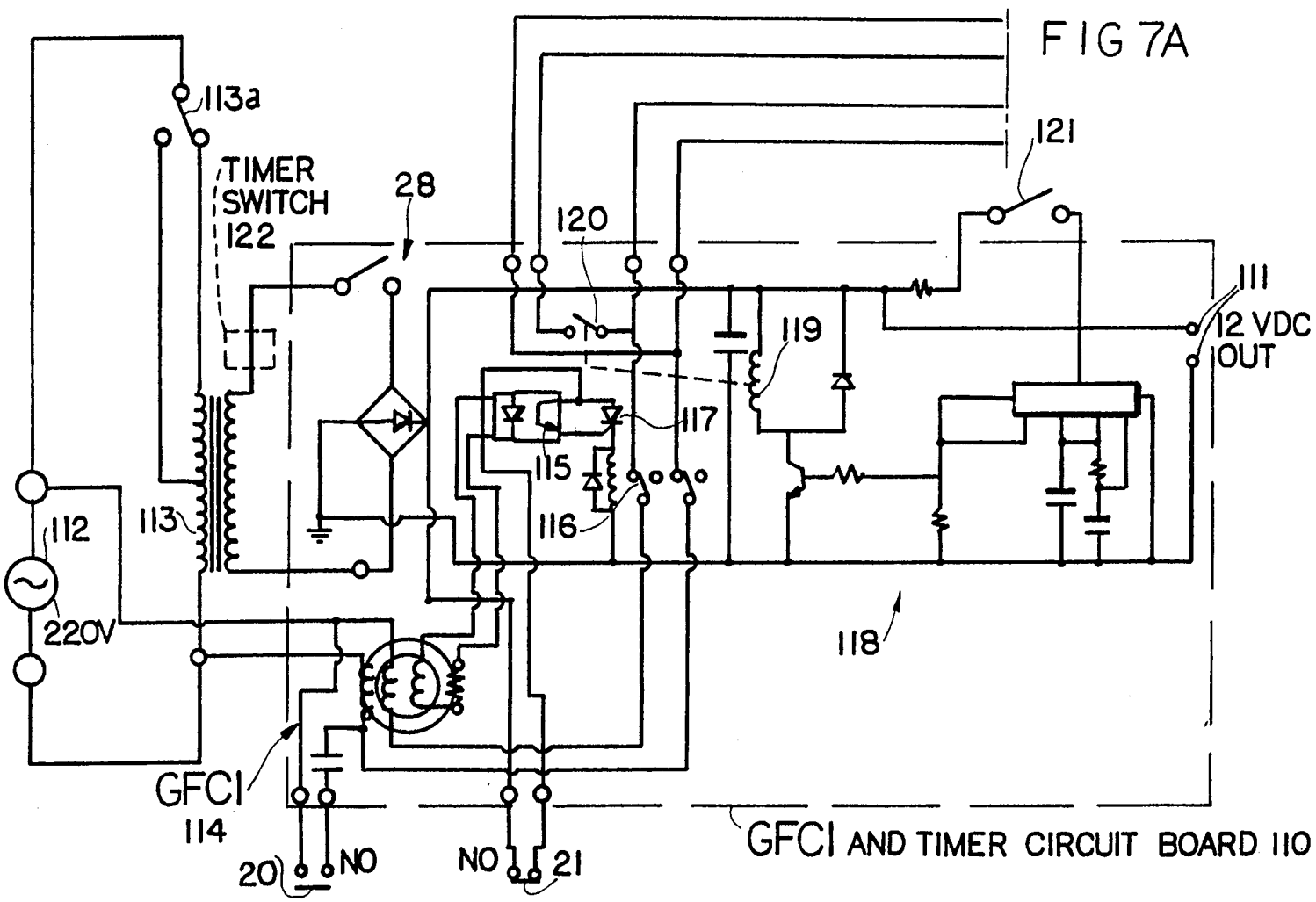
FIG. 7A–7B is a circuit diagram of circuit means in the embodiment of FIG. 3.
Figure 7B:
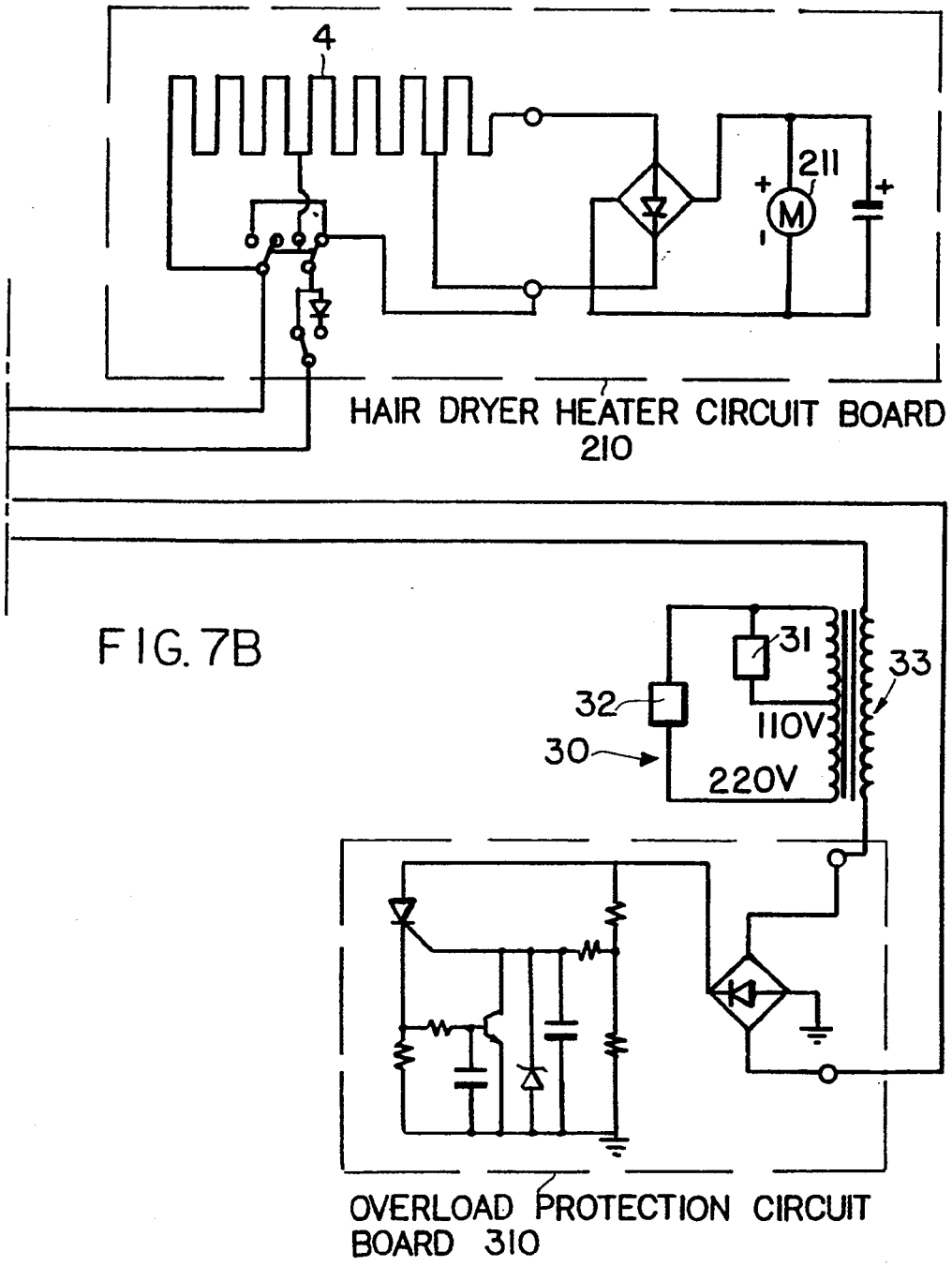

FIG. 7 is a circuit diagram of the embodiment shown in FIG. 3 with the shaver module 30 connected in the circuit. The circuit comprises a number of circuit elements mounted on respective circuit boards which are replaceable in the event that one of the circuit elements becomes inoperative. The circuit boards include a GFCI and timer circuit board 110, a hairdryer, heater circuit board 210 and an overload protection circuit board 310. The GFCI and timer circuit board 110 is contained within the housing 7'. The circuit 110 has output terminals 111 supplying 12 volts d.c. for power supply to each of the modules when it is inserted into the respective cut out in the housing. The hair dryer heater circuit board 210 is connected to the GFCI and timer circuit board 110 for supply of power to the heater element 4 and the blower motor 211 of the hair dryer 1. The overload protection circuit 310 is associated with the shaver socket module 30. Connected to the circuit board 310 is the isolation transformer 33 which supplies voltage to the socket 31 for 110 volts and the socket 32 for 220 volts.

The circuit 110 is connected to the power supply 112 which is 220 volts. The power supply 112 is connected to a transformer 113 through a voltage selector switch **113*a*. Connected to both legs of the power supply 112 is a GFCI 114 which monitors any difference in magnitude of the current in both legs of the power supply at all times. If a difference exists of the order of as low as 20 mA the GFCI operates an opto-isolator LED 115 which in turn operates a double pole double throw relay 116 via a silicon controlled rectifier 117. The relay 116 isolates both the isolation transformer 33 of the shaver socket module and the hair dryer heater circuit from the power supply when the GFCI 114 is activated. Once the relay is activated by the silicon controlled rectifier, it is maintained in the active position to disconnect the heater circuit and shaver socket module. The silicon controlled rectifier "latches" and requires manual resetting by reset switch 21. The test switch 20 when operated manually simulates a fault and checks the correct operation of the GFCI. Included in the circuit 110 is a timer circuit 118 which incorporates a relay 119 operating a switch 120 for controlling the time of operation of the dryer after activation. Also connected in the power supply to the dryer is the switch 28 which operates in accordance with the setting of the nodules on the daisy wheel in response to the degree of extension of the power cable 6 from the housing 7. The timer circuit 118 which operates the relay 119 is reset when the hair dryer 1 is replaced in its receptacle 17 and the electrical cable 6 has been retracted into the unit. In order to activate the timer circuit 118 a microswitch 121 is placed in the circuit, the switch 121 being controlled by the insertion and removal of the nozzle of the hair dryer in the receptacle 17** in the housing.

As evident from the above, there are three levels of electrical protection provided by the circuit. The first level of electrical protection is the inclusion of the GFCI, the second is in the operation of the hair dryer on/off function due to the winding and unwinding of the electrical cable 6 and the third is in the timer circuit which will interrupt the power to the hair dryer after a suitable period of time of operation. The isolation transformer 33 is an additional level of protection associated with the shaver module.

The switch **113*a* for selecting the voltage to be supplied to the unit is placed in the housing and is initially operated when the housing is installed on the base 9**.

A mechanical timer switch 122 can optionally be incorporated into the circuit in order to start the operation and the elapsed time of the entire circuit.

Although the invention has been described in relation to specific embodiments thereof, it will become apparent to those skilled in the art that numerous modifications and variations can be made within the scope and spirit of the invention as defined in the attached claims.

What is claimed is:

1. Hair dryer apparatus adapted for multifunctional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply, said housing including a receptacle for said hand-held dryer with an opening at said receptacle through which heated air produced by said dryer is introduced into said housing, a plurality of air outlets in said housing respectively configured for specific functions including nail and hand drying and supplying defogging air, control means accessible from outside said housing for selectively directing the heated air from said dryer to said outlets, a manifold in said housing for receiving the heated air from said hair dryer, said control means selectively directing the flow of heated air in said manifold to said air outlets.

2. Hair dryer apparatus as claimed in claim 1, comprising a rotatable dryer drum in said housing for selectively receiving heated air from said dryer by said control means.

3. Hair dryer apparatus as claimed in claim 1, comprising timer means accessible from outside said housing for setting the time of supply of heated air to said dryer and said plurality of outlets.

4. Hair dryer apparatus as claimed in claim 1, wherein said control means comprises a control element connected to said manifold and supported in said housing for movement between a plurality of selected positions respectively corresponding to the different air outlets of specific function and conduit means in said housing connecting said control element and said plurality of outlets for selectively transmitting heated air to the respective outlets in correspondence with the selected position of the control element.

5. Hair dryer apparatus adapted for multifunctional use comprising a housing attachable to a wall, a hand-held hair dryer, electrical power supply means within said housing, an electrical cable connecting said hand-held dryer in said electrical power supply means, switch means for controlling electrical connection of said electrical cable to said electrical power supply means, said hand-held dryer producing heated air when connected to said electrical power supply, said housing including a receptacle for said hand-held dryer with an opening at said receptacle through which heated air produced by said dryer is introduced into said housing, a plurality of modular accessory units, means in said housing for detachable connection of a selected modular accessory unit to said housing, circuit means connected to said electrical supply means for providing an electrical outlet connection in said housing, each said modular accessory unit including electrical utilization means with inputs which are electrically connected to said electrical outlet connection when the accessory unit is connected in said housing.

6. Hair dryer apparatus as claimed in claim 5 wherein at least one of said accessory units includes heated air utilization means, said housing including control means for supplying the heated air produced by said dryer to said heated air utilization means of said one accessory unit.

7. Hair dryer apparatus as claimed in claim 5, wherein said accessory units and said housing include snap-fit connection means.

8. Hair dryer apparatus as claimed in claim 5, comprising a GFCI in said circuit means between said electrical supply means and both said hair dryer and said selected accessory unit.

9. Hair dryer apparatus as claimed in claim 5, wherein said housing includes a plurality of means for detachable connection of a plurality of modular accessory units at the same time.

10. Hair dryer apparatus as claimed in claim 9, wherein each of said plurality of modular accessory units is electrically connected to said electrical power supply means through a respective electrical outlet connection and said GFCI.

11. Hair dryer apparatus as claimed in claim 5, wherein said accessory units include an illuminated panel, an electrical shaver unit having respective outlets for different electrical voltages, an air freshener unit, and an illuminated mirror.

12. Hair dryer apparatus as claimed in claim 5 wherein said housing has a plurality of cut outs in which said modular accessories are interchangeably engageable.

13. Hair dryer apparatus comprising a housing attachable to a support surface, a hand-held hair dryer containing heating means, electrical power supply means within said housing, an electrical cable connecting said hair dryer to said electrical power supply means for heating said heating means, switch means for interrupting supply of electrical power from said power supply means to said hair dryer, support means for supporting said hair dryer in said housing, storage means for the storage of said electrical cable within said housing when the dryer is supported by said support means and for extension of said cable from said housing when the dryer is removed from the support means and moved away from the housing, means for operating said switch means for supplying electrical power to said heating means when the handle is displaced from the dryer by a pre-set distance, and a ground fault circuit interrupter between said hair dryer and the electrical power supply.

14. Hair dryer apparatus as claimed in claim 13, wherein said switch means and said ground faucet circuit interrupter are connected in series.

15. Hair dryer apparatus as claimed in claim 13, wherein said storage means comprises a rotatable reel on which the electrical cable is wound.

16. Hair dryer apparatus as claimed in claim 13, wherein said storage means comprises spring means acting to retract said electrical cable within the housing.

17. Hair dryer apparatus as claimed in claim 15, wherein said means for operating said switch means comprises manually adjustable means rotatable with said reel for controlling the operation of said switch means as a function of the length of cable which is removed from said reel.

18. Hair dryer apparatus as claimed in claim 17, wherein said manually adjustable means comprises a plurality of circumferentially spaced bendable elements on a daisy wheel rotatable with said reel, said bendable elements, facing said switch means for operating the same when bent to an operative position.

19. Hair dryer apparatus as claimed in claim 13, comprising at least one air outlet means in said housing and control means accessible from outside said housing for selectively directing the heated air from said hair dryer to said air outlet means.

20. Hair dryer apparatus as claimed in claim 19, wherein a plurality of said air outlet means are provided and configured for specific functions, said control means selectively directing the heated air from said hair dryer to a selected air outlet means.

21. Hair dryer apparatus as claimed in claim 20, wherein said control means comprises a drum having one position to supply heated air from the hair dryer to said tumble dryer to operate the latter and other positions to supply heated air to selected air outlet means.

22. Hair dryer apparatus as claimed in claim 13, further comprising a plurality of modular accessory units, means in said housing for detachable connection of a selected modular accessory unit in said housing, circuit means connected to said electrical supply means and including said ground fault circuit interrupter and said switch means, said circuit means providing an electrical outlet connection in said housing, said modular accessory unit including electrical utilization means with inputs which are electrically connected to said electrical outlet connection when the accessory unit is connected in said housing.

23. Hair dryer apparatus adapted for multifunctional use comprising a housing attachable to a wall, a hand-held hair dryer, electrical power supply means within said housing, an electrical cable connecting said hand-held dryer to said electrical power supply means, switch means for controlling electrical connection of said electrical cable to said electrical power supply means, said hand-held dryer producing heated air when connected to said electrical power supply means, said housing including a receptacle for said hand-held hair dryer with an opening at said receptacle through which heated air produced by said hair dryer is introduced into said housing, a plurality of separate air outlet means in said housing configured for specific functions, a rotatable tumble dryer in said housing, control means accessible from outside said housing for selectively directing the heated air from said hair dryer to said tumble dryer and said air outlet means, and a manifold in said housing for receiving the heated air from said hair dryer, said control means comprising a drum having one position to supply heated air from the hair dryer to said tumble dryer to operate the latter and other positions to supply heated air to selected air outlet means.

* * * * *